US010301047B2

(12) United States Patent
Otxoa-Aizpurua Calvo et al.

(10) Patent No.: US 10,301,047 B2
(45) Date of Patent: May 28, 2019

(54) METHOD AND APPARATUS FOR VACUUM PACKAGING A PRODUCT

(71) Applicant: ULMA Packaging Technological Center, S.COOP., Oñati (ES)

(72) Inventors: Alberto Otxoa-Aizpurua Calvo, Oñati (ES); Gerardo Mendizabal Altuna, Oñati (ES); Eneko Izquierdo Ereño, Oñati (ES)

(73) Assignee: ULMA PACKAGING TECHNOLOGICAL CENTER, S.COOP., Oñati (ES)

( * ) Notice: Subject to any disclaimer, the term of this patent is extended or adjusted under 35 U.S.C. 154(b) by 314 days.

(21) Appl. No.: 15/233,219

(22) Filed: Aug. 10, 2016

(65) Prior Publication Data

US 2016/0347489 A1 Dec. 1, 2016

Related U.S. Application Data

(63) Continuation of application No. PCT/EP2015/051085, filed on Jan. 21, 2015.

(30) Foreign Application Priority Data

Feb. 14, 2014 (EP) ..... 14382053

(51) Int. Cl.
*B65B 31/02* (2006.01)
*B65B 51/26* (2006.01)
(Continued)

(52) U.S. Cl.
CPC ..... *B65B 31/021* (2013.01); *B65B 9/20* (2013.01); *B65B 9/2007* (2013.01);
(Continued)

(58) Field of Classification Search
CPC ..... B65B 51/26; B65B 51/303; B65B 31/021; B65B 31/048; B65B 9/2007; B65B 9/20; B65B 61/06
See application file for complete search history.

(56) References Cited

U.S. PATENT DOCUMENTS 2,145,941 A * 2/1939 Maxfield ..... B65B 9/20 206/205
2,387,812 A * 10/1945 Sonneborn ..... B65B 9/20 156/286
(Continued)

FOREIGN PATENT DOCUMENTS

EP 0175448 A1 3/1986
EP 0273066 A1 7/1988
(Continued)

OTHER PUBLICATIONS

European Search Report in corresponding European Application No. 14382053, dated May 27, 2014.
(Continued)

*Primary Examiner* — Alexander M Valvis
*Assistant Examiner* — Thomas M Wittenschlaeger
(74) *Attorney, Agent, or Firm* — Edell, Shapiro & Finnan, LLC

(57) ABSTRACT

A method and apparatus for vacuum packaging a product. According to one embodiment a film tube is generated, and, in the film tube a product (P) is introduced and at least one cut is made. In the method, a vacuum may also applied inside the film tube, and a transverse seal is formed therein, a film tube closed at one end being obtained upstream of the cut and a package closed at both ends being obtained downstream. Furthermore, the film tube is transversely pinched, a portion the inside of the film tube which is isolated from the inside of the rest of the film tube being obtained, and a chamber is demarcated around at least part
(Continued)

of said portion, the vacuum being applied and the transverse sealing operation being performed inside said chamber.

9 Claims, 12 Drawing Sheets

(51) Int. Cl.
*B65B 61/06* (2006.01)
*B65B 9/20* (2012.01)
*B65B 31/04* (2006.01)
*B65B 51/30* (2006.01)

(52) U.S. Cl.
CPC ..... *B65B 31/048* (2013.01); *B65B 51/26* (2013.01); *B65B 51/303* (2013.01); *B65B 61/06* (2013.01)

(56) References Cited

U.S. PATENT DOCUMENTS 3,518,809 A * 7/1970 Ott ..... B65B 31/06 53/511
3,545,983 A * 12/1970 Woods ..... B65B 31/022 426/395
3,958,391 A * 5/1976 Kujubu ..... B65B 31/022 53/434
4,077,184 A * 3/1978 Kremer, Jr. ..... B65B 11/52 53/427
4,601,159 A * 7/1986 Mugnai ..... B65B 31/04 53/511
4,754,596 A * 7/1988 Yasumune ..... B65B 31/022 53/373.4
4,779,398 A * 10/1988 Glandon ..... B65B 31/022 53/434
4,964,259 A * 10/1990 Ylvisaker ..... B65B 9/073 53/374.8
5,170,609 A * 12/1992 Bullock ..... B29C 65/18 53/434
5,682,727 A * 11/1997 Harte ..... B65B 31/024 53/434
6,131,371 A * 10/2000 Esser ..... B65B 31/00 53/433
6,889,487 B2 * 5/2005 Suga ..... B65B 31/00 53/510
7,040,074 B2 * 5/2006 Knowlton ..... B29C 65/743 383/7
7,464,521 B2 * 12/2008 Koke ..... B65B 31/021 53/202
7,726,104 B2 * 6/2010 Buchko ..... B65B 31/024 53/405
2003/0159405 A1 * 8/2003 Knowlton ..... B29C 65/743 53/434

FOREIGN PATENT DOCUMENTS

EP 1221411 A1 7/2002
EP 2500286 A1 9/2012
FR 2291919 A1 6/1976
JP 2007-230614 A 9/2007

OTHER PUBLICATIONS

International Search Report in corresponding International Application No. PCT/EP2015/051085, dated Mar. 27, 2015.

* cited by examiner

METHOD AND APPARATUS FOR VACUUM PACKAGING A PRODUCT

CROSS-REFERENCE TO RELATED APPLICATIONS

This application relates to and claims the benefit and priority to International Application No. PCT/EP2015/051085, filed Jan. 21, 2015, which claims the benefit and priority to European Application No. 14382053.8, filed Feb. 14, 2014.

TECHNICAL FIELD

The present invention relates to methods and apparatus for vacuum packaging products.

BACKGROUND

In some cases, vertical forming machines and/or installations are used for unit packaging or for bulk packaging of products. Inclined packaging machines for packaging fragile products are also known. In other cases, horizontal packaging machines are used; said machines can be very fast because unlike what occurs in vertical or inclined systems, the travelling speed of the product in horizontal packaging systems does not depend on gravity.

In the aforementioned machines, a film tube is obtained from a film that is sealed longitudinally; said tube is then separated into individual packages with a product contained therein by means of transverse sealing and cutting. Generally, one end of a package is closed (the other end is closed by the previous cutting/sealing operation), one end of a new package is sealed and a cut is made between both ends in one and the same operation, a package closed at both ends and a new film tube closed at one end being obtained.

In a horizontal packaging machine the obtained film tube is horizontal and is supported by transport means such as a conveyor belt. When the product to be packaged is introduced in the film tube, said product is supported on the conveying means during the rest of the packaging process. In contrast, in a vertical packaging machine the obtained film tube is vertical, and when the product to be packaged is introduced in the film tube it falls inside the film tube due to gravity. The product is then supported by the film tube itself during the rest of the packaging process, in particular it is supported by the closed end of the film tube, and additional safety measures have to be taken into account for preventing the film tube from being accidentally broken due to the weight of the product. Therefore, a vertical packaging machine faces problems not present in a horizontal packaging machine, and said problems remains when the products must be vacuum packaged, in addition to the difficulty in applying the vacuum in a film tube. For this reason, the film tube is generally formed in the vertical machine, and once the product is introduced in the film tube closed at one end, said portion of film tube closed at one end with the product contained therein is separated from the rest of the film tube for subsequently applying the vacuum and sealing the package in a subsequent process in another station of the machine, or in a different machine designed for that purpose.

Application EP2296974A1 discloses a vacuum packaging station that receives a bag (or a package) open at one of its ends with the product contained therein, and then extracts gas from inside the bag and seals the bag to obtain a package after correctly positioning the bag.

Document U.S. Pat. No. 3,958,391A1 also discloses an apparatus for vacuum packaging products. The apparatus receives a bag (or a package) open at one of its ends with the product contained therein.

Application WO2010/018239A1 belonging to the applicant discloses a vertical packaging machine comprising a forming tube, film feeding means suitable for applying a film on the forming tube, longitudinal film sealing means, first transverse film sealing means to form an upper closure seal and a lower closure seal, and a chamber configured for internally housing a portion of the film tube separated from the rest of the film tube and extracting the air contained in said portion. The first transverse film sealing means produces an upper closure seal with an opening, and the chamber comprises seconds sealing means suitable for sealing the opening once the air is extracted from inside the portion through said opening in the chamber.

Application EP2500286A1 discloses a vacuum forming apparatus comprising a first vacuum space member and a second vacuum space member disposed on opposite sides of the film tube. Both vacuum space members cooperate with each other to generate an inner space where the film tube is cut, the gas from the inside of the tube being evacuated through said cut.

SUMMARY OF THE DISCLOSURE

According to some embodiments a method is provided wherein at least one film tube with one closed end is generated, at least one cut is made in the film tube, a vacuum is applied on the film tube for extracting at least part of the gas present inside the film tube, and a transverse sealing operation is performed in an area of the film tube upstream of the product, a new film tube closed at one end being obtained upstream of the cut and a package closed at both ends with a product vacuum packed therein being obtained downstream of the cut. Before making the cut and forming a transverse seal, the product to be packaged is introduced in the film tube such that when the vacuum is applied on the film tube the product is already present inside said film tube.

According to some embodiments the film tube is further transversely pinched upstream of the product in at least one pinching area of the film tube, a portion of the film tube closed at one end with product therein and the inside of which film tube is isolated from the inside of the rest of the film tube being obtained downstream of the pinch; and a chamber is demarcated around at least part of said portion such that said part is at least partially isolated from the outside of said chamber. The cut communicates the inside of the portion of the film tube with the chamber, and the vacuum inside the film tube is applied directly on said chamber with the cut arranged in said chamber, such that at least part of the gas present inside said portion is extracted through the cut. After applying the vacuum inside the film tube, the transverse sealing operation is performed inside said chamber.

As a result of the use of the aforementioned method, the steps necessary for obtaining a vacuum packed product are thus reduced since a package separated from the film tube does not have to travel to an independent chamber where the vacuum is applied, for example, the process speed thus being increased. Furthermore, the elimination of steps simplifies the method, which entails greater ease when implementing the method and reduces possible sources of error. Sealing precision is increased at the same time since, as a result of pinching, the film tube remains secured without the risk of it moving during sealing, defective packages being reduced in number or altogether eliminated. In addition, as the transverse sealing operation is performed inside the same chamber in which the cut is performed and on which the vacuum operation is applied, the film surpluses generated are decreases.

According to some embodiments a machine is provided for vacuum packaging a product comprises at least means for generating a film tube closed at one end from at least one film, at least cutting means to make at least one cut in the film tube, extraction means for applying a vacuum inside the film tube and thus extracting at least part of the gas present inside the film tube, and transverse sealing means suitable for forming at least one transverse seal in an area of the film tube and obtaining, after transverse sealing, a new film tube closed at one end upstream of the cut and a package closed at both ends downstream of the cut.

According to some embodiments the machine further comprises a tool formed by two opposing actuation elements between which the film tube is arranged and moves, which are suitable for cooperating with one another and which pinch the entire width of the film tube in at least one pinching area when they cooperate with one another, a portion of the film tube which is closed at one end being generated downstream of the pinching area, and they demarcate a chamber around at least part of said portion, said portion being at least partially isolated from the outside of the tool. The tool comprises the transverse sealing means and cutting means housed therein. The advantages mentioned above are obtained with the machine.

These and other advantages and features of the will become evident in view of the drawings and the detailed description.

DETAILED DESCRIPTION

Figure 1:
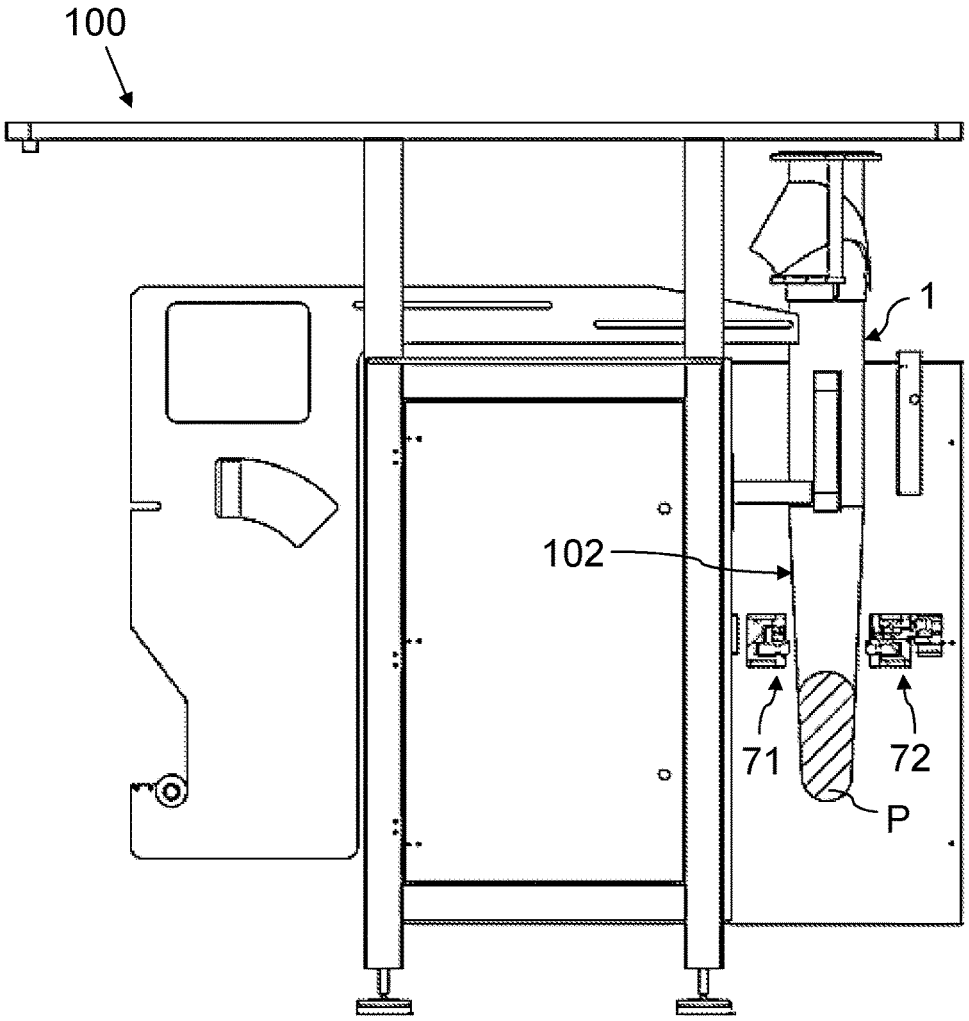
FIG. 1 shows a schematic view of a first embodiment of a machine with a film tube closed at one end internally comprising a product.

A first aspect relates to a method for vacuum packaging a product P, which is implemented in a vertical packaging machine 100 such as that shown in the drawings, for example. The method is suitable for enabling packaging liquid, solid or mixed products P, both with and without a protective atmosphere, for example.

According to some embodiments a method is provided that comprises the following steps:

- generating a film tube 102 closed at one end such as that shown by way of example in FIG. 1, from at least one laminate;
- introducing a product P to be packaged in the film tube 102 closed at one end;
- making at least one cut on the film tube 102 upstream of the product P;
- applying a vacuum in the film tube 102 for extracting at least part of the gas present inside the film tube 102; and,
- after applying the vacuum, performing a transverse sealing operation in an area of the film tube 102 upstream of the product P. During the transverse sealing operation, two transverse seals are preferably formed, one on each side of the cut, but a single transverse seal covering the cut may also be applied, such that after sealing a new film tube 102 closed at one end is obtained upstream of the cut and a package 200 closed at both ends with a product P vacuum packed therein is obtained downstream of the cut.

Figure 2A:
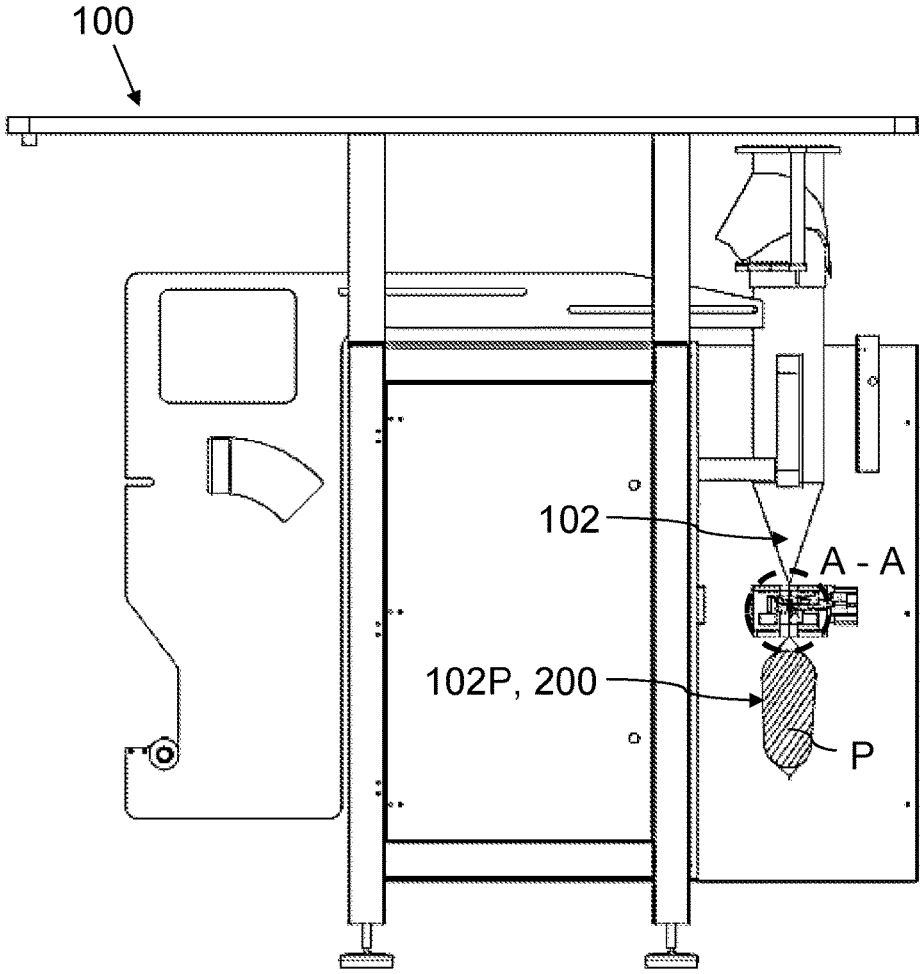
FIG. 2*a* shows the machine of FIG. 1 with the actuation elements of a tool cooperating with one another.
Figure 2B:
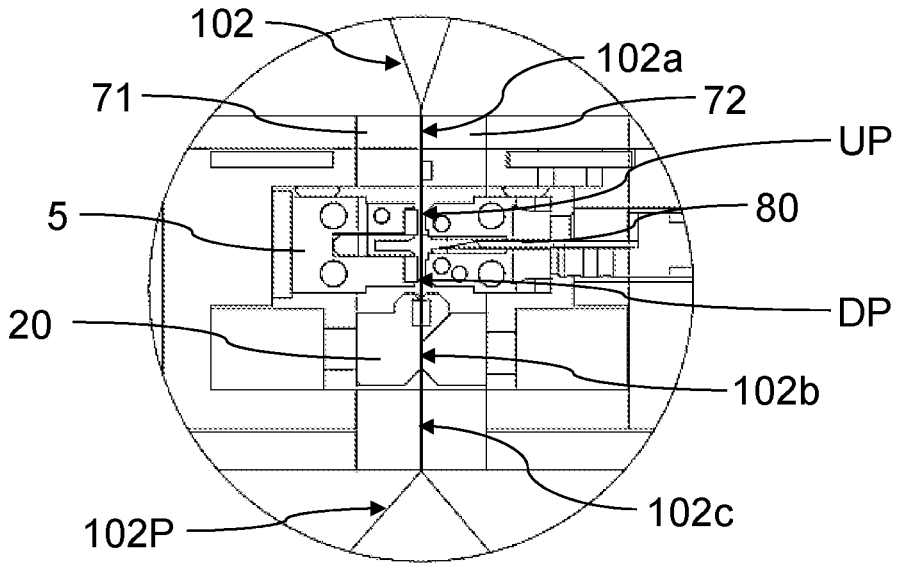
FIG. 2*b* shows detail A-A of FIG. 2*a*.
Figure 2C:
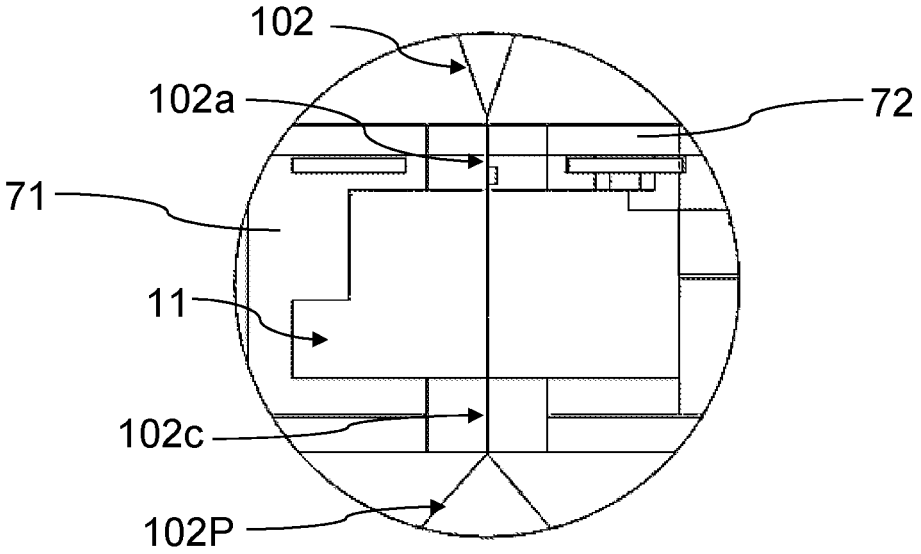
FIG. 2*c* shows detail A-A of FIG. 2*a*, but without the elements that are housed inside the tool.
Figure 3:
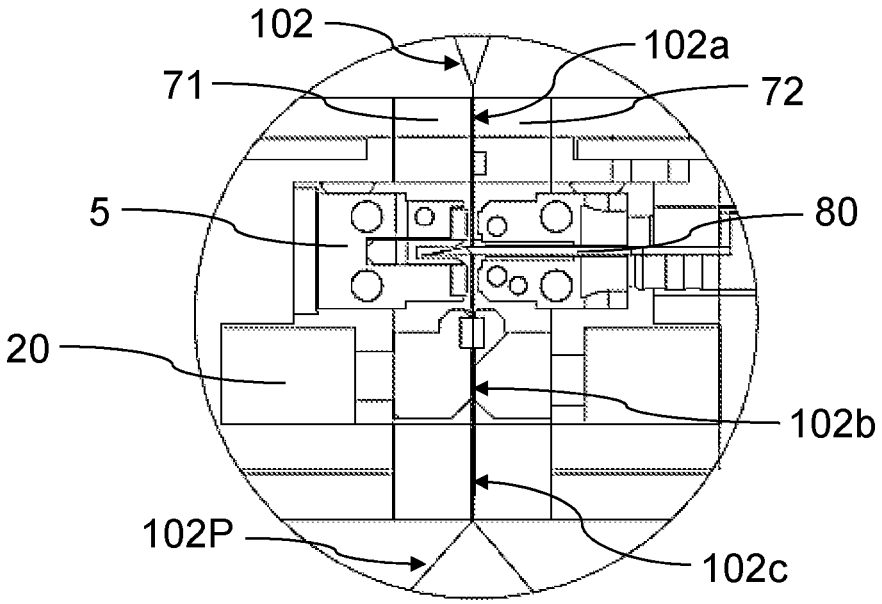
FIG. 3 shows detail A-A of FIG. 2*a*, but with a cutting blade making a cut in the portion of the film tube.
Figure 4:
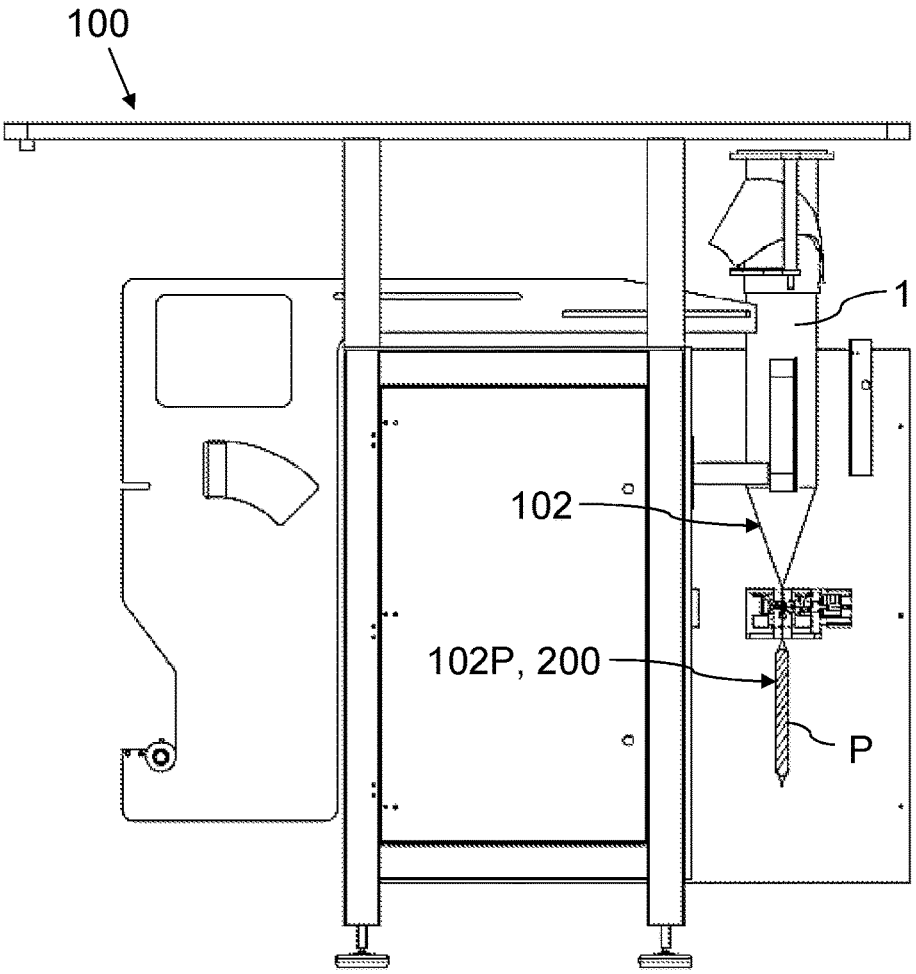
FIG. 4 shows the machine of FIG. 1 once the vacuum is applied on the film tube.
Figure 5:
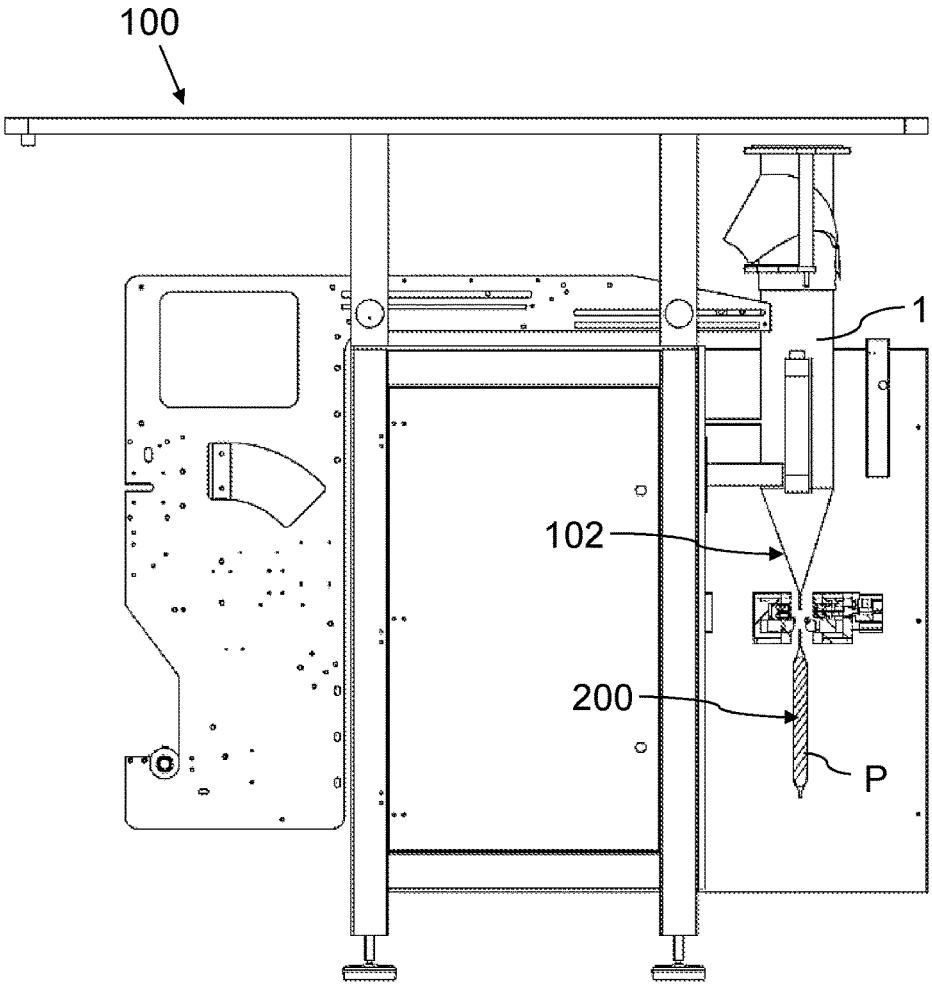
FIG. 5 shows the machine of FIG. 1 with a package comprising a product vacuum packed therein and said package being separated from the film tube.

In the method, the film tube 102 is further transversely pinched upstream of the product P in at least one pinching area 102*a* of the film tube 102, as shown by way of example in FIGS. 2*a*, 2*b* and 2*c*, and the cut is made (or is arranged) between said pinching area 102*a* and the product P as shown by way of example in FIG. 3. With the pinch, a portion 102P of the film tube 102 is obtained downstream of the pinching area 102*a*, and the portion 102P is closed at the end opposite the pinching area 102*a* and internally comprises a product P, the inside thereof being further isolated from the inside of the rest of the film tube 102. The vacuum is applied on said portion 102P, such that at least part of the gas present in said portion 102P is extracted through the cut since said inside is isolated from the inside of the rest of the film tube 102. FIG. 4 shows, by way of example, a package 200 with a product P after having applied the vacuum, showing how said package 200 occupies less volume than that depicted in FIG. 2*a*, for example, as it is (at least partially) free of gas, and FIG. 5 shows the package 200 physically separated from the rest of the film tube 102, the package 200 being ready to be delivered.

In the method, a chamber 11 is further demarcated around at least part of the portion 102P of the film tube 102, preferably at the same time the film tube 102 is transversely pinched, such that said part is at least partially isolated from the outside of said chamber 11. Before applying the vacuum, the cut is arranged such that it is located inside the chamber 11 when said chamber 11 is demarcated (either because said cut is moved to that position or is made in the part of the film tube 102 which is in the chamber 11), and with the cut in said position, the vacuum is applied directly on said chamber 11, such that since the inside of the portion 102P is communicated with the chamber 11 through the cut, at least part of the gas present inside said portion 102P is also extracted through said cut. A transverse seal is then formed on the tube film inside the chamber 11, at both sides of the cut (or only one transverse seal covering the cut), and the product P vacuum packed inside the portion 102P is obtained. Therefore, as the transverse sealing operation is performed inside the same chamber 11 in which the cut is performed and on which the vacuum operation is applied the film surpluses generated during vacuum packaging a product are decreases. In particular, the amount of film between the most upstream disposed point UP and the most downstream disposed point DP of the seals (or of the only seal) is decreased.

Having at least one transverse pinch such as the aforementioned, which covers the entire width of the film tube 102 in the pinching area 102*a*, and generating a chamber 11 such as the aforementioned for isolating the inside of the portion 102P from the inside of the rest of the film tube 102, has at least the following advantages:

- assuring a correct transverse sealing since the area of the film tube 102 of the portion 102P to be sealed and the cut remain substantially stationary;
- reducing the number of steps of a process or method for vacuum packaging a product P, which entails a process speed increase and therefore allows increased productivity;
- simplifying the method, which entails greater ease when implementing the method and reduces the possible sources of error; and
- allowing the introduction of a product P to be packaged while a preceding product P is being vacuum packed, which also increases process speed. Since one area of the film tube 102 is transversely pinched and two inner areas of the film tube 102 (an inner area downstream of the pinching area 102*a*, the inside of the portion 102P; and another inner area upstream of the pinching area 102*a*, the inside of the rest of the film tube 102) are isolated with said pinch, a product P can be introduced inside the film tube 102 upstream of the pinching area 102*a*.

Figure 6:
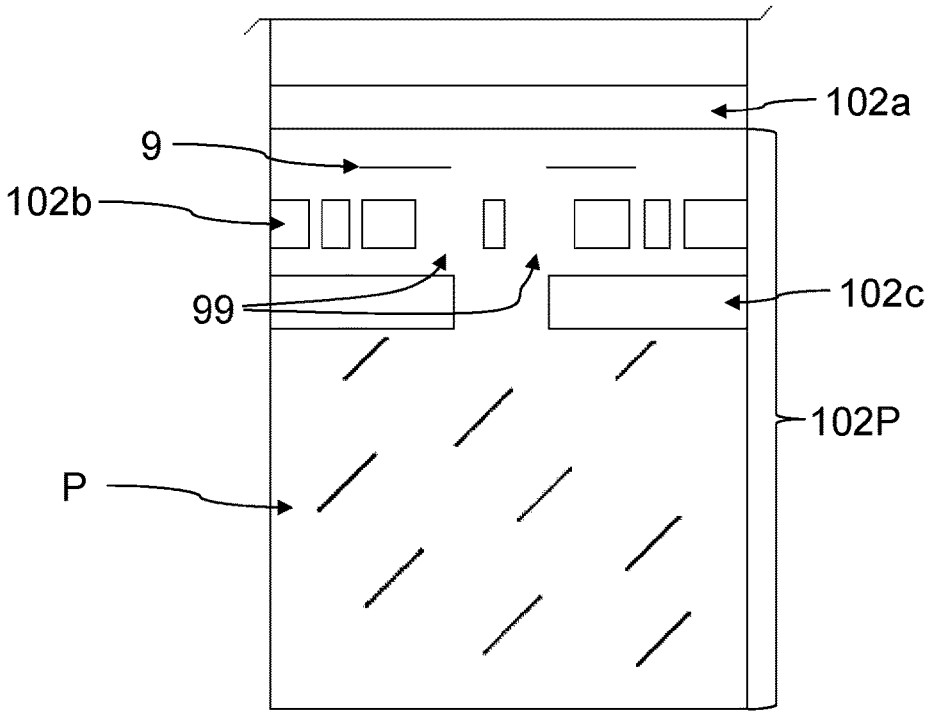
FIG. 6 shows, by way of example, a film tube formed with the machine of FIG. 1, while it is being pinched by the tool of said machine.

The cut through which gas is extracted from inside the portion 102P of the film tube 102 can correspond with a partial cut 9 such as that depicted by way of example in FIG. 6, which does not cover the entire width of the film tube 102 and allows said portion 102P to remain physically attached to the rest of the film tube 102; or it can correspond with a complete cut covering the entire width of the film tube 102 and physically separating said portion 102P from the rest of the film tube 102. In the first case, it is also necessary to make a second cut, after the partial cut 9 and preferably during or after the transverse sealing operation, covering the entire width of the film tube 102 for physically separating said portion 102P from the rest of the film tube 102. The partial cut 9 is made in a specific area of the film tube 102, preferably when said area is in the chamber 11 once said chamber 11 is demarcated, even though it may be made before it was in the chamber 11, then being moved to the position where the chamber 11 will be demarcated (so that the cut is inside the chamber 11 at any given time). Hereinafter, and for the sake of clarity of explanation, the partial cut 9 is understood as being made with said area in the chamber 11 unless otherwise indicated, although as mentioned above this does not have to be the case. The complete cut can in turn be a cut independent from the partial cut 9 or can be a cut completing the partial cut 9 along the width of the film tube 102.

The partial cut 9 is preferably made by cutting means suitable for making two cuts on the film tube 102: a first cut through which at least part of the gas present inside the portion 102P is extracted when applying the vacuum, said first cut being a partial cut 9 not covering the entire width of the film tube 102 and allowing the part of the portion 102P downstream of the cut to remain physically attached to the rest of the film tube 102; and a second cut covering the entire width of the film tube 102 and physically separating the film tube 102 into two parts. Preferably the cutting means is transversely moved to a first position, towards the film tube 102, to make the partial cut 9, and to a second position, towards the film tube 102, to make the second cut. In some embodiments the cutting means comprises a single cutting implement which is suitable for making the partial cut 9 and the second cut, said cutting implement being a cutting blade 80 and being transversely moved to the first position and to the second position when required in order to make the corresponding cut. In others embodiment the cutting means comprises a first cutting implement that is transversely moved to a first position towards the film tube 102, to make the partial cut 9, and a second cutting implement that is transversely moved to a second position, towards the film tube 102, to make the second cut.

The method can further comprise a holding step in which the part of the portion 102P which is in the chamber 11 is held transversely in a holding area 102*b*, said transverse holding being maintained at least while making the cut, applying the vacuum and performing part of the sealing operation. The transverse holding is preferably performed simultaneously with the transverse pinch described above (although it could be performed independently), the cut being made for extracting gas from inside the portion 102P and forming the transverse seal in the area of said portion 102P arranged between the transverse pinch and the transverse holding. The transverse holding assures having a part of the portion 102P that is stationary and surrounded by the chamber 11 (at least that which is arranged between the transverse pinch and the transverse holding) and in which partial and/or complete cutting, vacuum and transverse sealing operations are performed, without the risk of said part moving during said operations, and they are therefore correctly performed. This therefore assures, to a greater extent, that the cut and transverse seal are carried out in a correct manner. The transverse holding does not cover the entire width of the portion 102P (as shown by way of example in FIG. 6) and preferably corresponds with a discontinuous holding area 102*b*, such that the passage of gas is allowed from inside said portion 102P towards the cut through the non-held areas 99 of the discontinuous holding area 102*b*, at least while applying the vacuum in the chamber 11. The transverse holding is preferably performed close to the cut (downstream of the cut, between the cut and the product P) for assuring to a greater extent that the portion 102P does not move while gas is extracted from inside it, favoring a correct subsequent transverse sealing operation.

The method can further comprise a pressing step, before applying the vacuum, in which the portion 102P of the film tube 102 is pressed from the outside to help discharge gas from inside said portion 102P. Pressure is exerted on part of the portion 102P enveloping at least part of the product P, which facilitates directing the gas present around the product P towards the cut. Pressure is preferably exerted on the entire product P, although it may also be exerted only on part of said product P (preferably the part of the product P farthest from the cut).

In a first embodiment of the method, the chamber 11 surrounds part of the portion 102P, and the method comprises, in addition to all the aforementioned steps, a second pinching step in which a second transverse pinch is performed on the portion 102P of the film tube 102 in a pinching area 102*c* between the cut and the product P, simultaneously with the first transverse pinch, the chamber 11 being demarcated between both transverse pinches (between the pinching areas 102*a* and 102*c*). Like the transverse holding, the second transverse pinch does not cover the entire width of the portion 102P (although the non-pinched areas do not have to coincide with the areas 99), such that in principle, the chamber 11 is not completely isolated from the outside, since it is communicated with the outside through the areas that are not pinched with said second transverse pinch.

In some embodiments, such as the first embodiment, the method further comprises a separating step in which the opposing areas of the film from which said film tube 102 is formed are separated from the outside of said film tube 102 into at least the areas of the portion 102P that are not pinched by the second transverse pinch of the film tube 102, such that said separation allows the passage of gas through said areas of the film for extraction from the portion 102P and causes the complete isolation of the chamber 11. Preferably the separation is achieved by means of suction applied to the portion 102P from the outside, in the areas that are not pinched by the second transverse pinch (in the discontinuous areas of the pinching area 102*c*) to cause, at least in said areas of the portion 102P, the opposing areas of the film of said portion 102P to separate from one another to facilitate the passage of gas therethrough at least while gas is being extracted from said portion 102P when the vacuum is applied in the chamber 11. The isolation of the chamber 11 occurs as the film of the film tube 102 is being suctioned, the entry of the outside air through the areas not pinched by the transverse pinch being prevented. Even though suction is applied preferably to achieve said separation, said separation could be achieved in other ways in other embodiments.

In the first embodiment of the method, the cut through which gas is extracted from inside the portion 102P of the film tube 102 corresponds with a partial cut 9, a subsequent second cut being necessary as described above.

In a variant of the first embodiment, the method is similar to that of said first embodiment but does not comprise the holding step. In other variants of the first embodiment, the method does not comprise the pressing step (with or without the holding step).

A second embodiment of the method is similar to the first embodiment, with the difference that the cut through which gas is extracted from inside the portion 102P of the film tube 102 corresponds with a cut covering the entire width of the film tube 102 and physically separating said portion 102P from the rest of the film tube 102.

In a variant of the second embodiment, the method is similar to that of said second embodiment but does not further comprise the holding step. In other variants of the second embodiment, the method does not comprise the pressing step (with or without the holding step).

In a third embodiment of the method, the chamber 11 surrounds the entire portion 102P. The method comprises the same steps as the first embodiment except for the second transverse pinching step and the suction step.

If the weight of the product P is low enough so as to not deform the film of the portion 102P of the film tube 102, it is possible to also dispense with the holding step, such that in a variant of the third embodiment, the method is similar to that of said third embodiment but without the holding step. In other variants of the third embodiment, the method does not comprise the pressing step (with or without the holding step).

A fourth embodiment of the method is similar to the third embodiment but with the difference that the cut through which gas is extracted from inside the portion 102P of the film tube 102 corresponds with a cut covering the entire width of the film tube 102 and physically separating said portion 102P from the rest of the film tube 102; the chamber 11 surrounds the entire portion 102P.

In a variant of the fourth embodiment, the method is similar to that of said fourth embodiment but does not comprise the holding step. In other variants of the fourth embodiment, the method does not comprise the pressing step (with or without the holding step).

A second aspect relates to a vertical packaging machine 100 for vacuum packaging a product P, where the method of the first aspect can furthermore be implemented in any of its embodiments and variants.

The machine 100 comprises feeding means (not depicted in the drawings) suitable for applying at least one film; means for generating a film tube 102 from the fed film, which preferably correspond with at least one forming tube 1 which is surrounded by the film from the feeding means and provides a tubular shape to the film, and longitudinal sealing means (not depicted in the drawings) for sealing the tubular-shaped film longitudinally; means (not depicted in the drawings) for introducing the products P to be packaged inside the film tube 102 automatically (although the products P could be introduced manually instead of automatically); cutting means to make at least one cut in the film tube 102; extraction means (not depicted in the drawings and it can correspond, for example, with a pump, a blower or a similar device) for applying a vacuum inside the film tube 102 and thus extracting at least part of the gas present inside the film tube 102; and transverse sealing means for forming at least one transverse seal in an area of the film tube 102 and obtaining after the transverse sealing a new film tube 102 closed at one end upstream of the cut and a package 200 closed at both ends downstream of the cut.

The machine 100 further comprises a tool formed by two opposing actuation elements 71 and 72 between which the film tube 102 is located, and actuation means (not depicted in the drawings) for causing the movement of at least one of said actuation elements 71 and 72. Said movement allows both actuation elements 71 and 72 to cooperate with one another, clamping the film tube 102 between them with said cooperation in at least one pinching area 102*a*, such that they perform at least one transverse pinch of the film tube 102. The tool can thus be open (the two actuation elements 71 and 72 not cooperating with one another, not contacting one another, as seen for example in FIGS. 1 and 5) or closed (the two actuation elements 71 and 72 cooperating with one another, as seen for example in FIGS. 2*a* and 4).

As described in the first aspect, a portion 102P of the film tube 102 sealed at one end opposite the pinching area 102*a*, furthermore housing a product P therein, and the inside of which is isolated from the inside of the rest of the film tube 102, is obtained downstream of the pinching area 102*a* with transverse pinch. Furthermore, when said actuation elements 71 and 72 cooperate with one another, a chamber 11 is demarcated between both elements 71 and 72 around at least part of the portion 102P, said part of the portion 102P being at least partially isolated from the outside of said tool.

The cutting means can be suitable for making a single cut on the film tube 102, in which case it is housed inside the tool making the cut in the part of the portion 102P which is surrounded by the chamber 11. Said cut covers the entire width of the film tube 102 and physically separates the film tube 102 into two parts: a part upstream of the cut and another part downstream of the cut. Furthermore, at least part of the gas present inside the portion 102P is extracted through said cut when applying the vacuum.

Alternatively, the cutting means can be suitable for making two cuts on the film tube 102: a first cut through which at least part of the gas present inside the portion 102P is extracted when applying the vacuum, said cut corresponding with a partial cut 9 not covering the entire width of the film tube 102 and allowing the part of the portion 102P downstream of the cut to remain physically attached to the rest of the film tube 102; and a second cut covering the entire width of the film tube 102 and physically separating the film tube 102 into two parts (as described in the preceding paragraph), said cut being able to be independent from the partial cut 9 or being able to complete said partial cut 9. There may be different alternatives in this case: the cutting means comprises a first cutting implement for making the partial cut 9 and a second cutting implement for making the second cut, the first implement being located upstream of the tool and the second implement being housed in the tool; or the cutting means comprises a first cutting implement for making the partial cut 9 and a second cutting implement for making the second cut, both implements being housed in the tool; or the cutting means comprises one and the same cutting implement for making both cuts, said implement being housed in the tool. In any of the three alternatives, the cutting means is housed in the tool at least in part.

The tool therefore comprises, housed therein, at least part of the cutting means and the transverse sealing means 5 forming a transverse seal on each side of the complete cut (or one covering the cut), a package 200 closed at both ends and separated from the rest of the film tube 102 being obtained. The transverse sealing means 5 preferably comprise two actuation members cooperating with one another to perform their corresponding task (generating the transverse seal), each of said members being attached to a corresponding actuation element 71 or 72, and at least one of said members being suitable for moving with respect to the actuation element 71 or 72 to which it is attached, both members thus being able to cooperate with one another. The machine 100 comprises actuation means (not depicted in the drawings) to cause said movement.

The extraction means are associated with the tool and communicated with the chamber 11, such that it is suitable for applying a vacuum in the chamber 11, thus at the same time extracting at least part of the gas present inside the portion 102P through a (partial or complete) cut of the film tube 102.

In a first embodiment of the machine 100 shown in FIGS. 1, 2*a*, 4 and 5, the tool is configured such that when it pinches the film tube 102 transversely, it only covers part of the portion 102P of the film tube 102, the chamber 11 only covering said part of the portion 102P of the film tube 102, as shown in FIGS. 2*b* and 2*c*. FIGS. 8*a*, 8*b*, 8*c* and 8*d* show the two actuation elements 71 and 72 of the tool, respectively, and each element 71 and 72 comprises a respective contact surface 79 contacting one another when said elements 71 and 72 cooperate with one another for pinching the film tube 102 transversely and generating the portion 102P and for demarcating the chamber 11. The drawings show that the actuation element 72 comprises a groove 79*a* in the contact surface 79, said groove 79*a* is used for housing a gasket (not depicted in the drawings) assuring the at least partial isolation of the chamber 11 with respect to the outside of the tool. The contact surface 79 of each element 71 and 72 comprises a transverse wall 71*a*, 72*a* which, together with the respective transverse wall 71*a*, 72*a* of the other actuation element 71 or 72, clamps the film tube 102 in the pinching area 102*a* when both actuation elements 71 and 72 cooperate with one another. If at least one of the contact surfaces 79 has a gasket, said gasket could clamp the film tube together with the transverse wall 71*a* or 72*a* of the other element 71 or 72. For the sake of clarity, clamping between two transverse walls 71*a* and 72*a* will be referred to hereinafter, but this is not limiting since at least one gasket as described could be used.

In the first embodiment, the contact surfaces 79 of the two elements 71 and 72 comprise a respective second transverse wall 71*b* and 72*b* separated from the transverse wall 71*a* and 72*a* which, together with the respective second transverse wall 71*b*, 72*b* of the other actuation element 71 or 72, clamps the film tube 102 in a second pinching area 102*c* when both actuation elements 71 and 72 cooperate with one another, a second transverse pinch being generated. The second transverse pinch assures having a part of the portion 102P that is stationary (between the two transverse pinches) and surrounded by the chamber 11 and in which the (partial and/or complete) cutting, transverse sealing and vacuum operations are performed, without the risk of said part moving during said operations, and they are therefore correctly performed.

Figure 8A:
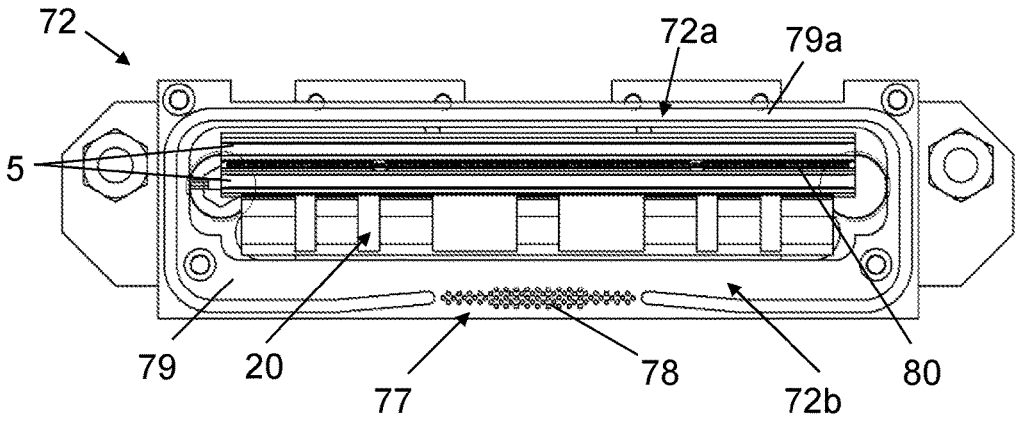
FIG. 8*a* shows a front view of an actuation element of the tool of the machine of FIG. 1.
Figure 8B:
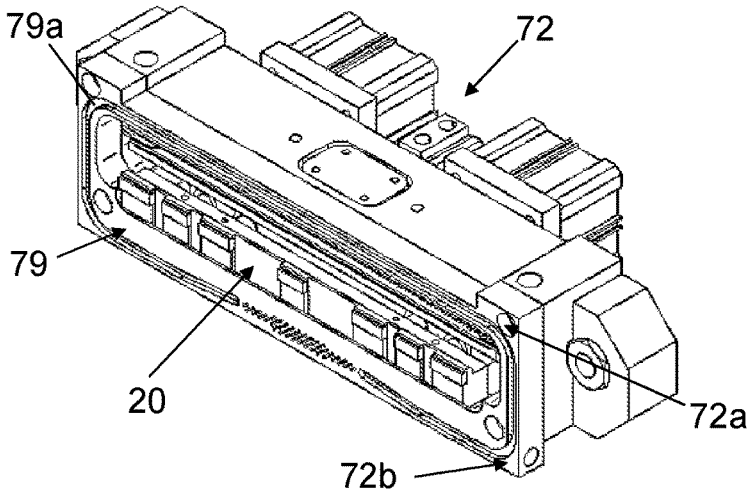
FIG. 8*b* shows a perspective view of the actuation element of FIG. 8*a*.

In the first embodiment, at least one of the second transverse walls 71*b* or 72*b* of one of the actuation elements 71 and 72 comprises an area of discontinuity 77 to prevent said second transverse walls 71 b and 72*b* from transversely pinching the entire width of the film tube 102 in the second pinching area 102*c*, such that the passage of gas is allowed from inside the portion 102P of the film tube 102 towards the cut through the area of discontinuity 77. In the cases in which at least one of the contact surfaces 79 has a gasket, said area of discontinuity 77 can be provided by the gasket, as shown in FIG. 8*a*, where the groove 79*a* has a discontinuity 77. Therefore, in this embodiment the chamber 11 is not completely isolated from the outside of the tool since it is communicated with said outside through said area of discontinuity 77.

Figure 8C:
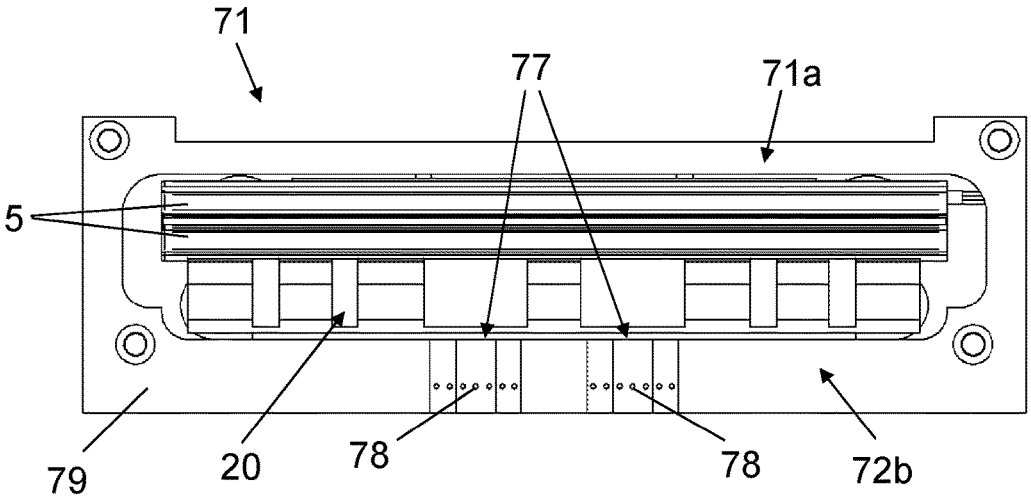
FIG. 8*c* shows a front view of the other actuation element of the tool of the machine of FIG. 1.
Figure 8D:
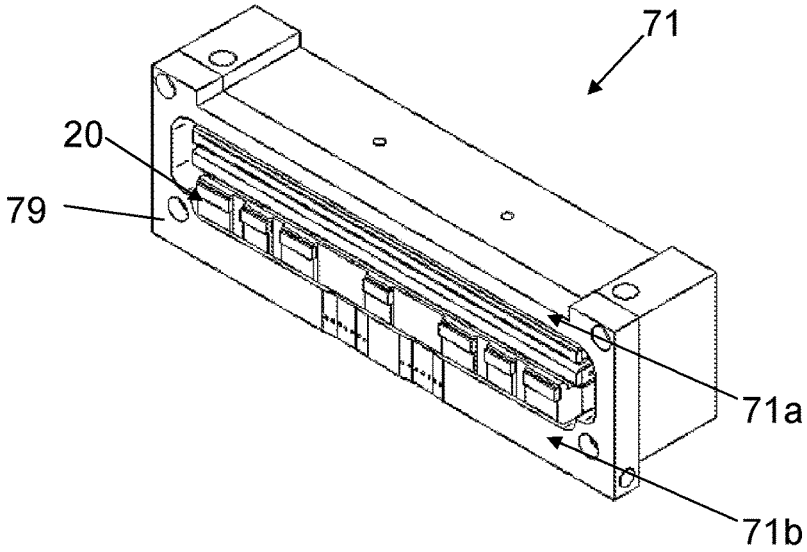
FIG. 8*d* shows a perspective view of the actuation element of FIG. 8*c*.

The machine 100 can comprise means for causing the separation of the opposing areas of the film from which said film tube 102 is formed, from the outside of the film tube 102, into at least the areas of the portion 102P that are not pinched by the second transverse pinch of the film tube 102, such that as a result of said means, the passage of gas through said areas of the film for extraction from the portion 102P is allowed and the complete isolation of the chamber 11 is caused. In the first embodiment, said means correspond with a plurality of holes 78 in the area of discontinuity 77 of the tool and with suction means suitable for applying suction on the film tube 102 through said holes 78 and from the outside of said film tube 102. As a result of this suction, the opposing areas of the film forming the film tube 102 are separated in said area of discontinuity 77 and remain separated, facilitating the passage of gas therethrough towards the cut. Furthermore, as the film tube 102 is suctioned against the walls 71*b* and 72*b*, an isolated space is generated in the chamber 11 defined by the contact surfaces 79 and the film tube 102 suctioned against the discontinuity 77, such that the entry of air from the outside of the chamber 11 is prevented, thus facilitating the vacuum operation. The suction means and the extraction means correspond with two independent devices that are controlled independently, but in other embodiments, they can correspond with one and the same device. In other embodiments of the machine 100, the tool could dispense with these holes 78 and the machine 100 could dispense with said suction means. In the first embodiment, the actuation element 72 comprises two areas of discontinuity 77 as shown in FIGS. 8*c* and 8*d*, but it may have a different number of areas of discontinuity or even none of such areas if the gasket was wide enough. In several variants of the first embodiment without a gasket, the areas of discontinuity 77 could be generated on the actual contact surface 79 of a single actuation element 71 and 72 or on the contact surface 79 of both actuation elements 71 and 72.

In the first embodiment, the machine 100 further comprises holding means 20 housed inside the tool, performing transverse holding on the portion 102P of the film tube 102, in this case between the first transverse pinch and the second transverse pinch and below the cut. The holding means 20 comprises an irregular surface to prevent holding the entire width of the film tube 102, said holding not covering the entire width of the film tube 102 like what occurs with the second transverse pinch (although the non-pinched areas do not have to coincide), such that the passage of gas is allowed from inside the portion 102P towards the cut through the areas that are not pinched by said holding means 20. The (partial and/or complete) cutting and transverse sealing operations are performed in the part of the portion 102P which is located between the first transverse pinch and said holding, the accuracy of the transverse seal and of the cut being greatly assured. The holding means 20 comprises two elements, one attached to each actuation element 71 and 72, at least one of them comprising freedom of movement with respect to its element 71 or 72 to allow the holding.

In the first embodiment, the machine 100 further comprises a clamp (not depicted in the drawings) downstream of the tool, comprising two opposing elements for clamping or pressing between one another the portion 102P of the film tube 102 from the outside to help discharge at least part of the gas present inside said portion 102P. In the first preferred embodiment, each of the elements of the clamp is fixed to a respective actuation element 71 and 72 of the tool, such that no additional means are needed for moving them and pressing on said portion 102P while at the same time performing transverse pinches. Pressure is exerted on the product P such that it facilitates directing the gas present around the product P towards the cut. In the first preferred embodiment, pressure is exerted on the entire product P, although pressure could be exerted only on part of said product P (preferably the part of the product P farthest from the cut). In other embodiments, the clamp could also be configured differently from that described.

Figure 7:
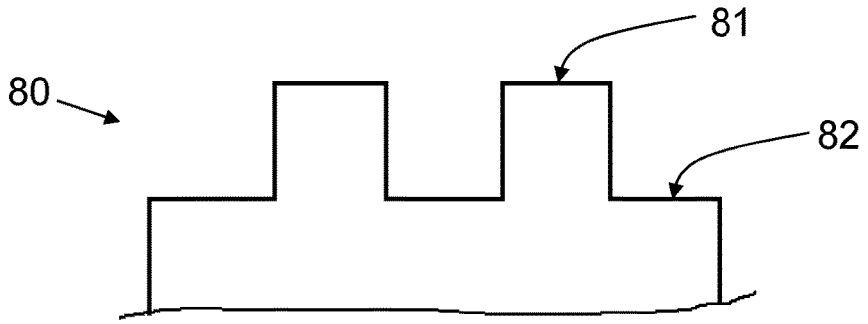
FIG. 7 shows, by way of example, a cutting blade of the machine of FIG. 1.

In the first embodiment of the machine 100, the cutting means comprises a single cutting implement which is suitable for making a partial cut 9 and the second cut and is housed inside the tool. The cutting implement corresponds with a cutting blade 80 which comprises at least one cutting edge facing the film tube 102 for making the cut in the portion 102P of the film tube 102, and which is movable with respect to the actuation element 71 or 72 to which it is attached. The actuation means responsible for causing the movement of the cutting blade 80 so that the blade makes the cut are suitable for causing the movement of the cutting blade 80 to at least a first position so that the cutting profile generates a partial cut 9 in the film tube 102 not covering the entire width of said film tube 102, and to at least a second position in which the cutting profile generates a complete cut covering the entire width of the film tube 102 and causing a physical separation between the portion 102P and the rest of the film tube 102. The cutting blade 80 preferably comprises a comb shape as shown by way of example in FIG. 7, such that the cutting edge comprises a first cutting surface 81 suitable for making the partial cut 9 when the cutting blade 80 is moved to the first position, and a second cutting surface 82 suitable for completing the partial cut 9 when the cutting blade 80 is moved to the second position, although it is also possible to use cutting blades 80 with different cutting edges, such as a triangular cutting edge, for example, the extent of the cut made by the cutting blade 80 depending on the length of the movement of the blade in this last case.

In a variant of the first embodiment, the machine 100 is similar to that of said first embodiment but is not suitable for carrying out a holding step, so it does not comprise holding means 20. In other variants of the first embodiment, the machine 100 does not comprise a clamp (with or without holding means 20).

In a second embodiment, the machine 100 is similar to the machine 100 of the first embodiment, with the difference that the cut through which gas is extracted from inside the portion 102P of the film tube 102 corresponds with a complete cut covering the entire width of the film tube 102 and physically separating said portion 102P from the rest of the film tube 102, the cutting means being those means suitable for such purpose.

In a variant of the second embodiment, the machine 100 is similar to the machine 100 of the second embodiment but does not comprise holding means 20. In other variants of the second embodiment, the machine 100 does not comprise a clamp (with or without holding means 20).

Figure 9:
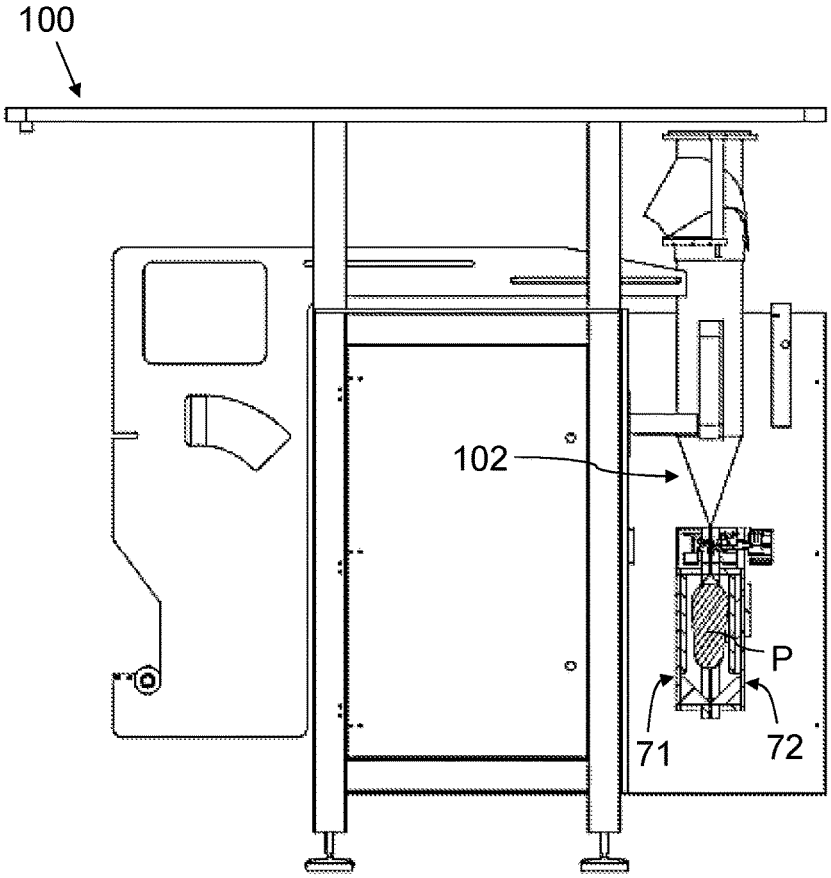
FIG. 9 shows a schematic view of a second embodiment of a machine with a film tube closed at one end internally comprising a product.
Figure 10A:
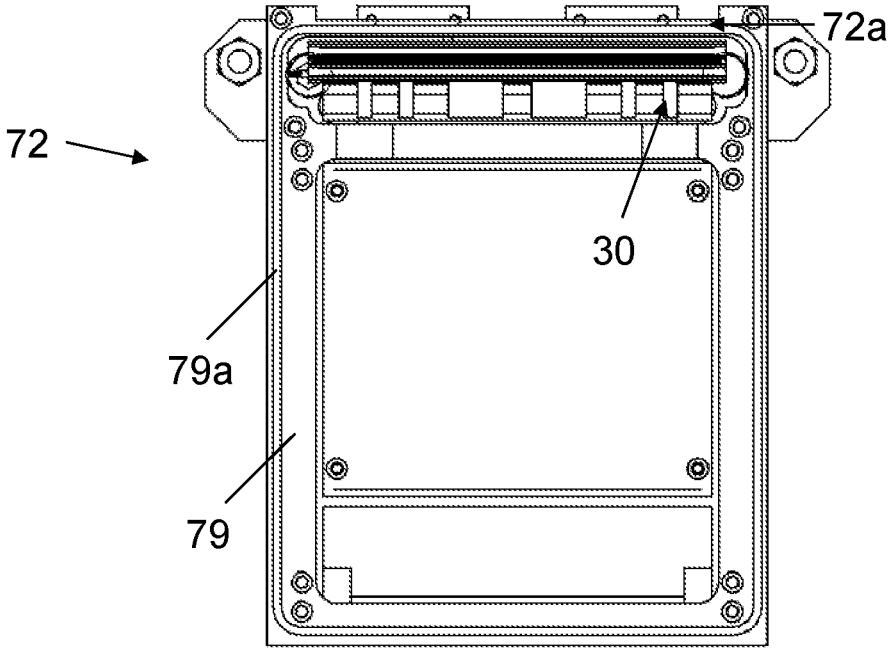
FIG. 10*a* shows a front view of an actuation element of a tool of the machine of FIG. 9.
Figure 10B:
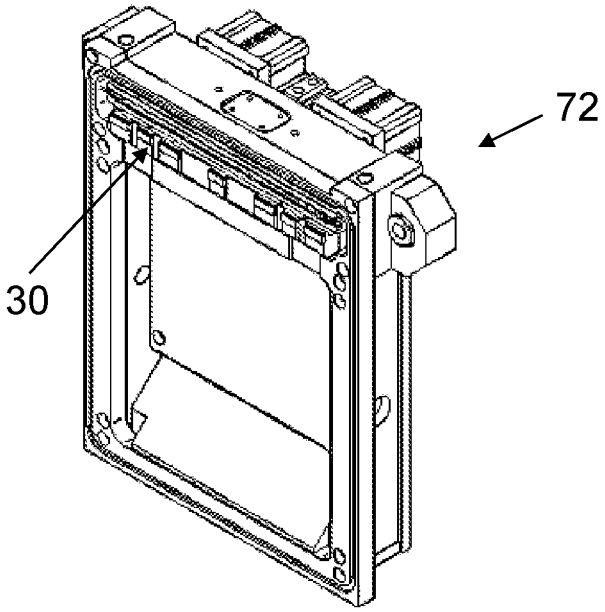
FIG. 10*b* shows a perspective view of the actuation element of FIG. 10*a*.
Figure 10C:
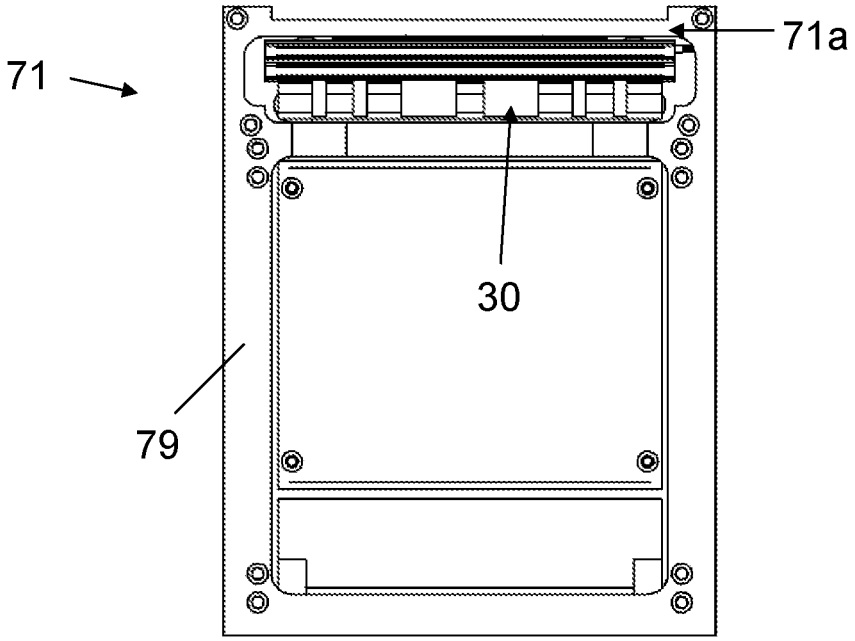
FIG. 10*c* shows a front view of the other actuation element of the tool of the machine of FIG. 9.
Figure 10D:
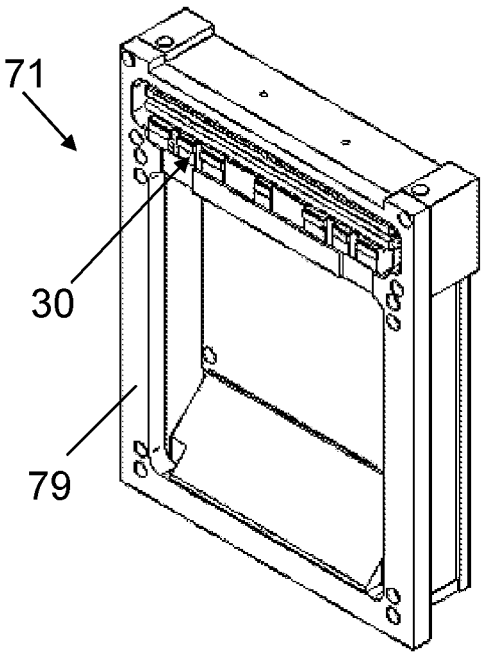
FIG. 10*d* shows a perspective view of the actuation element of FIG. 10*c*.

In a third embodiment of the machine 100 shown by way of example in FIG. 9, the tool is configured such that when it pinches the film tube 102 transversely, it covers the entire portion 102P of the film tube 102, the chamber 11 covering the entire portion 102P of the film tube 102 and said chamber 11 being completely isolated from the outside of the tool. FIGS. 10*a*, 10*b*, 10*c* and 10*d* show the two actuation elements 71 and 72 of the tool, respectively. Like what occurred with the preceding embodiments, the machine 100 in the third embodiment is suitable for performing a first transverse pinch in a first pinching area 102*a* upstream of the cut and a transverse holding downstream of the cut in the film tube 102. The machine 100 of the third embodiment does not perform a second transverse pinch like what occurred in the first embodiment, and for the transverse holding step, the tool comprises at least movable holding means 30 housed in the tool which is responsible for performing said transverse holding and are similar to the holding means 20 described for the first embodiment.

In the third embodiment, the cutting means is similar to that of the first embodiment, such that the (partial and complete) cutting and transverse sealing operations are performed on the part of the portion 102P which is located between the transverse pinching area 102*a* and the holding, which assures having a part of the portion 102P that is stationary (between the transverse pinch and the transverse holding), without the risk of said part moving during said operations, and they are therefore correctly performed. Like in the first embodiment, in the third embodiment the vacuum is applied in the chamber 11 and the first transverse pinch is similar to that described for the first embodiment.

In several variants of the third embodiment comprising a tool such as the tool of said third embodiment, the machine 100 does not comprise holding means 30 (in this case, a partial cut 9 would be necessary at first and a complete cut during or after the sealing operation for sealing the film tube 102). In other variants of the third embodiment, the machine 100 does not comprise a clamp (with or without holding means 30).

In a fourth embodiment, the machine 100 is similar to the machine 100 of the third embodiment, with the difference that the cut through which gas is extracted from inside the portion 102P of the film tube 102 corresponds with a complete cut covering the entire width of the film tube 102 and physically separating said portion 102P from the rest of the film tube 102, the cutting means being those means suitable for such purpose.

What is claimed is:

1. A method for vacuum packaging in a vertical packaging machine a product located inside a film tube between first and second end portions of the film tube, the first end portion being located below the second end portion, the film tube transportable from an upstream position to a downstream position located below the upstream position, the film tube having a width, the method comprising:

sealing the first end portion of the film tube, placing the product inside the film tube, placing the second end portion of the film tube inside a chamber so that the second end portion is at least partially isolated from the outside of the chamber, by use of a cutting tool, creating a partial cut in the film tube inside the chamber by cutting the second end portion of the film tube along less than the entire width of the film tube, pinching a first part of the film tube between a first wall and a second wall along the entire width of the film tube in an area above the cutting tool without creating a permanent seal in the first part, the pinching of the first part forming a temporary seal along the entire width of the film tube through which air is prevented to pass, the pinching of the first part being performed prior to creating the partial cut in the film tube;

pinching a second part of the film tube located below the first part of the film tube without creating a permanent seal in the second part, the pinching of the second part being applied between a third wall and a fourth wall and across less than the width of the film tube after the product is placed inside the film tube, the pinching creating one or more pinched areas along the width of the film tube through which air is prevented to pass and one or more non-pinched areas along the width of the film tube through which air is permitted to pass, the second part being located between the cutting tool and the product, the pinching of the second part being performed prior to creating the partial cut in the film tube, the pinching of the first part and the pinching of the second part occurring simultaneously to form the chamber between the first and second parts;

creating a vacuum in the chamber to extract air from inside the film tube through the partial cut and the one or more non-pinched areas; and by use of the cutting tool, creating a complete cut in the film tube by cutting the second end portion of the film tube along the entire width of the film tube.

2. The method according to claim 1, wherein the partial cut is made with the cutting tool being in a first position, and wherein the complete cut is made with the cutting tool being in a second position that is different from the first position.

3. The method according to claim 1, further comprising sealing the second end portion of the film tube after the extracting of air from the film tube at a location downstream the complete cut when the second end portion is located inside the chamber.

4. The method according to claim 1, further comprising transversely supporting the second end portion at the pinched areas by use of a holder located inside the chamber and below the cutting tool.

5. The method according to claim 1, wherein the film tube comprises opposing areas, the method further comprising separating the opposing areas along the one or more non-pinched areas of the second part of the film tube by suction applied to an outside of the film tube along the one or more non-pinched areas.

6. The method according to claim 1, wherein the cutting tool moves between a first horizontal position and a second horizontal position, in the first horizontal position the cutting tool is not in contact with the film tube, in the second horizontal position the cutting tool contacts the film tube to create the partial cut in the film tube.

7. A vertical packaging machine for vacuum packaging a product located inside a film tube between first and second end portions of the film tube, the first end portion being located below the second end portion, the packaging machine configured to transport the film tube in a vertical direction from an upstream position to a downstream position located below the upstream position, the film tube having a width, the vertical packaging machine comprising:

a sealing assembly configured to form a transverse seal across each of the first and second end portions of the film tube, a chamber configured to receive therein the second end portion of the film tube, the chamber being at least partially isolated from an outside of the chamber, the sealing assembly being located inside the chamber when the vertical packaging machine is operated;

a cutting tool for creating a cut in the film tube in the area of the second end portion of the film tube when the second end portion is located inside the chamber, the cutting tool moveable between a first horizontal position and a second horizontal position, when in the first horizontal position the cutting tool is configured to form a partial cut in the film tube by cutting the second end portion of the film tube along less than the entire width of the film tube, when in the second horizontal position the cutting tool is configured to form a complete cut in the film tube by cutting the second end portion of the film tube along the entire width of the film tube: and a tool in which the chamber resides when the vertical packaging machine is operated, the tool configured to pinch a first part of the film tube along the entire width of the film tube in an area above the cutting tool without creating a permanent seal in the first part, the tool further configured to pinch a second part of the film tube in an area below the cutting tool without creating a permanent seal in the second part, the tool configured such that the pinching of the second part is applied across less than the width of the film tube.

8. The vertical packaging machine according to claim 7, further comprising a holder that is located below the cutting tool, the holder being configured to pinch but not permanently seal the second end portion of the film tube along only a portion of the width of the film tube, the holder being a part of the tool.

9. The vertical packaging machine according to claim 7, further comprising an area that allows suction to be applied to the one or more non-pinched areas.

* * * * *